United States Patent [19]

Wedel

[11] Patent Number: 4,807,371

[45] Date of Patent: Feb. 28, 1989

[54] APPARATUS FOR MAINTAINING THE EDGES OF A WEB IN CONFORMITY WITH A DRYER FELT

[75] Inventor: Gregory L. Wedel, Beloit, Wis.

[73] Assignee: Beloit Corporation, Beloit, Wis.

[21] Appl. No.: 126,547

[22] Filed: Nov. 30, 1987

Related U.S. Application Data

[63] Continuation-in-part of Ser. No. 14,569, Feb. 13, 1987.

[51] Int. Cl.[4] ..... F26B 13/08

[52] U.S. Cl. ..... 34/117; 34/123

[58] Field of Search ..... 34/158, 117, 116, 123, 34/15, 120

[56] References Cited

U.S. PATENT DOCUMENTS 3,868,780 3/1975 Soininen et al. ..... 34/117 X 4,510,698 4/1985 Ely ..... 34/117

*Primary Examiner*—Henry A. Bennet

*Attorney, Agent, or Firm*—Dirk J. Veneman; Raymond W. Campbell; David J. Archer

[57] ABSTRACT

An apparatus is described for maintaining a first and second lateral edge of web in close conformity with a dryer felt of a papermaking machine. The apparatus includes a first dryer drum which is rotatable about an axis which is parallel to the cross-machine direction of the web. A second dryer drum is rotatable about an axis which is spaced and parallel relative to the axis of the first dryer drum. An intermediate transfer roll has an axis of rotation disposed in a plane parallel to, and between, the axes of the first and second drums such that the web and the felt extend contiguously around the first dryer drum and then around the transfer roll and subsequently around the second drum in a serpentine configuration so that the transfer roll and the felt define therebetween a pocket. A first and second box are disposed within the pocket and adjacent to, respectively, the first and second lateral edges of the web for maintaining a partial vacuum within the pocket adjacent to the respective lateral edges such that the edges are drawn into close conformity with the felt which is disposed between the web and the boxes thereby inhibiting detachment of the respective lateral edges from the felt and subsequent wrinkling of the dried web.

14 Claims, 5 Drawing Sheets

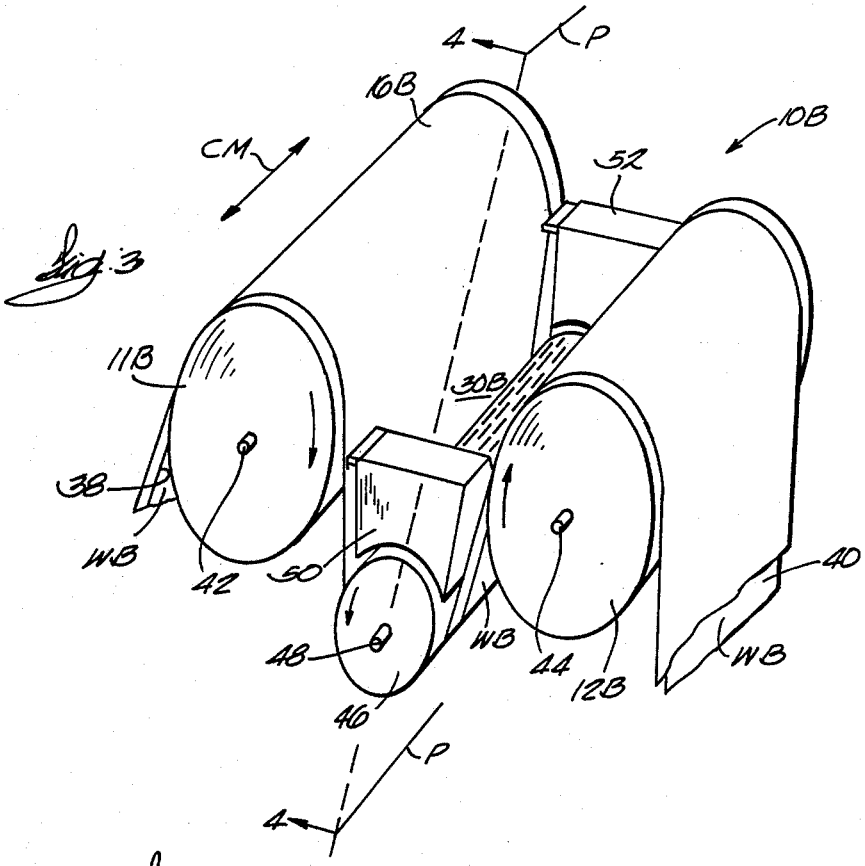
Fig. 3
Fig. 4
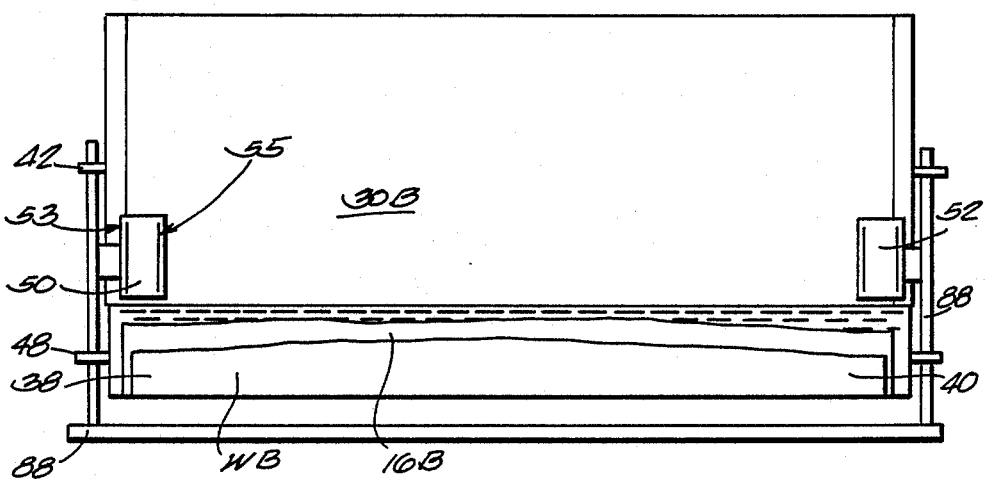

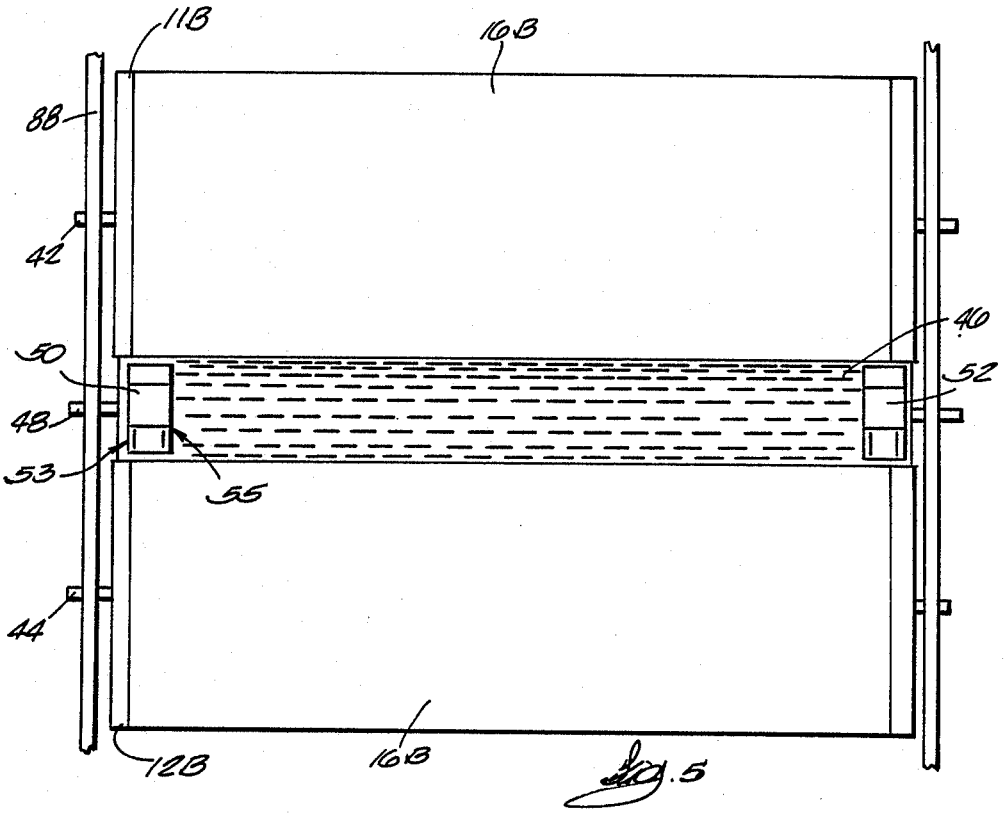
Fig. 5
Fig. 6
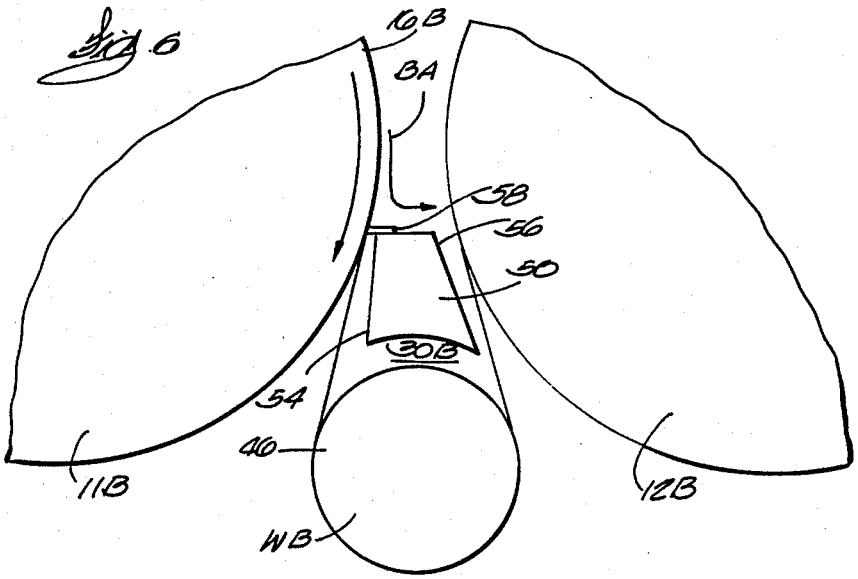

APPARATUS FOR MAINTAINING THE EDGES OF A WEB IN CONFORMITY WITH A DRYER FELT

CROSS REFERENCE TO RELATED PATENT APPLICATION

This application is a continuation-in-part of co-pending U.S. Application Ser. No. 014,569 filed Feb. 13, 1987. All of the disclosure of Serial No. 014,569 is incorporated herein by reference.

BACKGROUND OF THE INVENTION

FIELD OF THE INVENTION

This invention relates to an apparatus for maintaining a first and second lateral edge of a web in close conformity with a dryer felt of a papermaking machine. More particularly, this invention relates to an apparatus for use in a BEL RUN type dryer section of a papermaking machine.

INFORMATION DISCLOSURE STATEMENT

In the papermaking art, typically, paper stock which includes at least 95% by weight of water is ejected from a headbox onto a moving drainage screen, or wire. Water is drained from the stock such that a wet paper mat is formed on the screen. This mat is transferred from the screen through a series of pressing operations to remove a substantial amount of the water still remaining in the formed web. The pressed web is then guided through a drying section of the papermaking machine where the web is guided around a plurality of heated dryers, or drums, in order to produce a web having the desired moisture content.

In recent years, with the advent of ever higher production speeds, there has been a tendency for the paper web to flutter during transfer between successive dryer drums. In drying sections operating at slower speeds, the movement of the paper web to the next downstream drum unsupported by a dryer felt posed few problems. However, with the aforementioned higher operational speeds, such open draws between dryer drums caused fluttering of the sheet and, in severe cases, breakage of the sheet.

In an attempt to overcome the problem of sheet flutter, the so-called "single felt" configuration was proposed in which the web and felt ran as a joint run between a top and bottom dryer drum or cylinder. Nevertheless, the single felt configuration introduced several disadvantages. First, the heat transfer from the bottom cylinders, or drums, was substantially reduced because the wet web no longer came into direct contact with the outer heating surface of the dryer drum. Second, the web had the tendency to separate from the felt during its travel towards, around, and away from the bottom cylinder or drum, and third, the initial threading of the web was more difficult due to the absence of any open draw between adjacent dryer drums.

The aforementioned problems have been solved to a large degree by the introduction of the so-called BEL RUN dryer section. BEL RUN is a registered trademark of Beloit Corporation. In the BEL RUN dryer configuration, the bottom ineffective dryers are replaced by vacuum rolls which positively convey the web from one cylinder to the next cylinder. Recent installations of the BEL RUN dryer section have shown that this concept can be extended to include a large number of dryers without any adverse effect on web runnability. Such runnability is achieved because the vacuum rolls are capable of conveying the web along the felt-supported spans without the need for sheet tension or section draw points.

However, in the BEL RUN configuration, short draw lengths still remain between the dryers and the effective vacuum zones of the intermediate vacuum transfer rolls. Although the web will generally be conveyed through the short draws with little or no separation from the felt, it has been observed that during machine upsets, the edges of the web may separate by up to one inch from the felt. Such upsets are usually short periods of time in which the basis weight (grammage) of the web and the moisture content of the web are non-uniform. The release characteristics of the web edges from the dryer surfaces during these periods occasionally cause the web to be pulled from intimate contact with the felt. Under these circumstances, the web is subjected to the disturbing influences of local air currents and centrifugal forces. The results of these disturbances can be undesirable wrinkling of the sheet edges or, in the extreme cases, a break in the web.

Although the aforementioned problem can be minimized by the provision of blow boxes extending in a cross-machine direction over the entire width of the paper web, the provision of such full length blow boxes is not entirely practical. The disadvantages of using a full length blow box are:

1. The air which is used to induce an underpressure to minimize sheet flutter requires a large fan and motor to supply enough air at sufficient pressure to induce the required vacuum.
2. The energy required for driving the aforementioned fan can be considerable, especially where many of the full length boxes are required on a wide paper machine.
3. The air which is delivered by such full length boxes is distributed by nozzles into the dryer hood within the felt loop rather than outside the loop where the more humid air accumulates.
4. These boxes tend to collect paper dust, broke, and tailings, which are strips of paper. Such debris can clog the nozzles and make them ineffective and may collect and form wads and damage the felts. The accumulation of such debris can also present a safety hazard to personnel who try to remove such debris from the dryer section.
5. The spaces between the dryers and intermediate rolls in the aforementioned BEL RUN configuration are relatively small and it is difficult to construct small full length boxes which have enough inherent strength to avoid excessive thermal and mechanical distortion. Accordingly, such full length boxes may occasionally contact the felt and the rolls causing damage to the same.

The aforementioned problems are overcome by the present invention through the provision of relatively small boxes disposed adjacent to the respective lateral edges of the web where the majority of sheet flutter originates. Such boxes cause the lateral edges of the web to be drawn into close conformity with the felt, thereby inhibiting wrinkling the dried web.

Therefore, it is a primary object of the present invention to provide an apparatus that overcomes the aforementioned inadequacies of the prior art proposals and which provides a significant and non-obvious contribution to the papermaking art.

Another object of the present invention is the provision of an apparatus including a first and a second box disposed within a pocket of a BEL RUN type dryer section for maintaining a partial vacuum within the pocket adjacent to the first and second lateral edges of a web such that the edges are drawn into close conformity with the felt, thereby inhibiting detachment of the edges from the felt.

Another object of the present invention is the provision of an apparatus in which each box includes at least one divergent wall which diverges relative to the moving dryer felt for generating a partial vacuum between the moving felt and the divergent wall, such partial vacuum drawing the adjacent lateral edge of the web into close conformity with the felt.

Another object of the present invention is the provision of an apparatus in which each box includes a seal which extends from one of the divergent walls and sealingly engages the moving felt where the felt diverges relative to a dryer drum, such seal diverting entrained boundary air from entry into the pocket adjacent to the respective lateral edge of the web.

Another object of the present invention is the provision of an apparatus in which each of the boxes includes sealing means for inhibiting the lateral flow of air from, or to, the pocket past each respective box.

Another object of the present invention is the provision of an apparatus in which such sealing means for preventing lateral flow of air includes longitudinal orifices defined by each box for directing air curtains out of the respective box for inducing a partial vacuum by the Coanda principle, such air curtains not only generating the desired partial vacuum for drawing the edge of the web toward the felt but also effectively sealing the box against lateral air currents.

Another object of the present invention is the provision of an apparatus including boxes disposed adjacent to the respective edges of the web, such boxes being secured to the frame of the dryer section.

Other objects and advantages of the present invention will be evident to those skilled in the art by a consideration of the detailed description contained hereinafter taken in conjunction with the annexed drawings and appended claims.

SUMMARY OF THE INVENTION

The present invention relates to an apparatus and method for maintaining a first and a second lateral edge of a web in close conformity with the dryer felt of a papermaking machine.

The apparatus includes a first dryer drum of the papermaking machine. The first drum is rotatable about an axis which is parallel to the cross-machine direction of the web. A second dryer drum is rotatable about an axis which is spaced and parallel relative to the axis of the first dryer drum. An intermediate transfer roll has an axis of rotation which is disposed in a plane parallel to, and between, the axes of the first and second drums such that the web and the felt extend contiguously around the first dryer drum and then around the transfer roll and subsequently around the second drum in a serpentine configuration so that the transfer roll and the felt define therebetween a pocket. A first box is disposed within the pocket and adjacent to the first lateral edge of the web for maintaining a partial vacuum within the pocket adjacent to the first lateral edge such that the first lateral edge is drawn into close conformity with the felt which is disposed between the web and the first box thereby inhibiting detachment of the first lateral edge from the felt and subsequent wrinkling of the dried web. A second box is disposed within the pocket and adjacent to the second lateral edge of the web for maintaining a partial vacuum within the pocket adjacent to the second lateral edge such that the second lateral edge is drawn into close conformity with the felt which is disposed between the web and the second box thereby inhibiting detachment of the second lateral edge from the felt and subsequent wrinkling of the dried web.

In a more specific embodiment of the present invention, the first box includes a first divergent wall which extends between the first drum and the transfer roll such that in use of the apparatus, movement of the web and contiguous felt relative to the first divergent wall generates a partial vacuum between the first divergent wall and the felt extending from the first drum to the transfer roll so that the first lateral edge of the web is drawn into close conformity with the felt.

The first box also includes a second divergent wall which extends between the transfer roll and the second drum such that during movement of the felt from the transfer roll to the second drum, a partial vacuum is generated between the second divergent wall and the felt between the transfer roll and the second drum for drawing the first lateral edge of the web into close conformity with the felt.

Furthermore, the first box also includes a seal which extends from the first divergent wall to the felt such that the seal slidingly engages the felt as the felt diverges relative to the first drum so that boundary air entrained by the felt extending around the first drum is diverted from entry into the pocket adjacent to the first lateral edge of the web.

Additionally, the first box also includes a first and a second lateral seal means for sealing the first box within the pocket such that lateral flow of air within the pocket and past the first box is inhibited.

In a first embodiment of the present invention, the first lateral seal means includes a first and a second longitudinal orifice defined respectively by the first and second divergent walls such that when the first box is connected to a source of pressurized air, a first and a second curtain of air flow respectively through the first and second orifices and laterally away from the pocket for sealing the first and second divergent walls respectively relative to the felt. The second lateral seal means includes third and fourth longitudinal orifices defined by the first and second divergent walls such that when the first box is connected to the aforementioned source of pressurized air, a third and fourth curtain of air respectively, flows through the third and fourth orifices and in a direction opposite to the flow of the first and second curtains of air respectively such that the first and second divergent walls are sealed relative to the felt.

In a second embodiment of the present invention, the first box also includes a first side wall which extends from the first divergent wall towards the second divergent wall. A second side wall is spaced relative to the first side wall and extends from the first divergent wall to the second divergent wall. The first lateral seal means also includes a first seal which extends from the first side wall to the felt for sealingly engaging the felt moving between the first drum and the transfer roll. A second seal extends from the first side wall to the felt for sealingly engaging the felt moving from the transfer roll to the second dryer. The second seal means includes a third seal which extends from the second side wall to the felt for sealingly engaging the felt moving from the first drum to the transfer roll and a fourth seal which extends from the second side wall to the felt for sealingly engaging the felt moving from the transfer roll to the second drum. The first, second, third and fourth seals inhibit lateral flow of air towards, and away, from the pocket past the first box.

In the second embodiment of the present invention, the boxes are not connected to a source of pressurized air or vacuum and the partial vacuum used to draw the lateral edges toward the felt is provided first by virtue of the respective divergent walls and secondly by the partial vacuum existing within the transfer roll, such partial vacuum extending into that portion of the pocket adjacent to the respective boxes.

In the first embodiment of the present invention, the boxes are connected to an independent source of pressurized air which may be separately controlled relative to the source of partial vacuum within the transfer roll.

In both of the aforementioned embodiments, the first and second dryer drums and transfer roll are rotatably secured to a frame and the respective boxes are also secured to the frame thereby minimizing mechanical and thermal distortion of the boxes.

Although the present invention will be described with a certain degree of particularity in the following detailed description, it should be appreciated by those skilled in the art that the present invention is not limited to the embodiments described hereinafter. Rather, the present invention is defined by the appended claims and many modifications and variations of the present invention can be made by those skilled in the art without departing from the spirit and scope of the present invention as defined by the aforementioned appended claims. For example, although the present invention has particular application to the so-called BEL RUN dryer system, the principles of this invention can be applied to many dryer section configurations. Also, although in the first embodiment, an underpressure is generated between the respective boxes and adjacent felt by supplying pressurized air to the boxes, it will be appreciated that such underpressure may be obtained by connecting the boxes to a source of partial vacuum so that air between the boxes and adjacent felt flows through holes in the boxes thereby drawing the edges into conformity with the felt.

BRIEF DESCRIPTION OF THE DRAWINGS

FIG. 3 is a perspective view of the apparatus according to a first embodiment of the present invention showing a BEL RUN dryer configuration having boxes disposed adjacent lateral edges of the web.

FIG. 4 is an enlarged, sectional view taken on the line 4—4 of FIG. 3.

FIG. 5 is a plan view of the apparatus shown in FIG. 3.

FIG. 6 is an enlarged, fragmentary side-elevational view of the apparatus shown in FIG. 3.

Similar reference characters refer to similar parts throughout the various embodiments of the present invention.

DETAILED DESCRIPTION OF THE DRAWINGS

Figure 1:
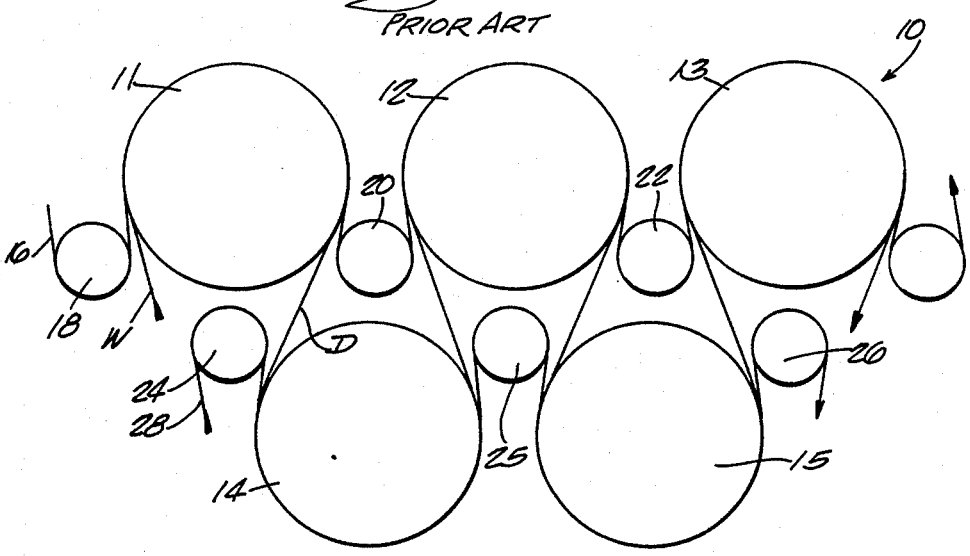
Fig. 1 PRIOR ART
FIG. 1 is a side-elevational view of a typical prior art double-felted dryer section showing the web extending in open draw between successive upper and lower dryer drums.

FIG. 1 is a side elevational view of a typical double-felted dryer section generally designated 10. The dryer section 10 includes a plurality of upper dryer drums 11, 12 and 13 and a plurality of lower dryer drums 44 and 15. A top felt 16 extends around a transfer roll 18 and around drum 11 and then around a second transfer roll 20 and around the drum 12. Thereafter the top felt 16 extends around a third transfer roll 22 and the drum 13. Lower transfer rolls 24, 25 and 26 are disposed alternately adjacent to lower drums 14 and 15 such that a lower dryer felt 28 extends in serpentine configuration around the roll 24, the drum 14, roll 25, the drum 15 and finally the transfer roll 26. The web W to be dried, extends in serpentine configuration successively around the drums 11, 14, 12, 15 and 13. Although this configuration causes the web to be dried alternately on both sides thereof and all of the dryer drums 11–13 and 14,15 are utilized for drying the web, such configuration necessitates an open draw D of the web between successive upper and lower dryer drums. Whereas such a configuration poses few problems when operating at relatively low production speeds, serious problems, often resulting in web breakages, are experienced when operating at high speed because the web, unsupported by an upper or lower felt, extends between upper and lower dryers with the tendency for sheet flutter therebetween.

Figure 2:
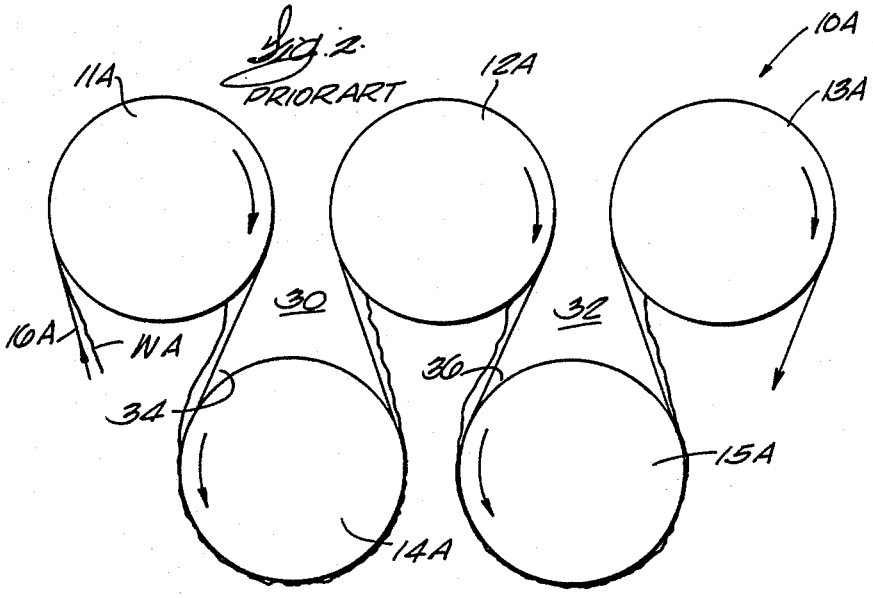
Fig. 2. PRIOR ART
FIG. 2 is a side-elevational view of a "single felt" dryer section in which the web moves together with the felt successively between adjacent upper and lower drying cylinders.

FIG. 2 shows a typical single-felted dryer section generally designated 10A having upper dryer drums 11A, 12A and 13A and lower dryer drums 14A and 15A. A single felt 16A extends successively around drums 11A, 14A, 12A, 15A and 13A and the web WA, in a joint run with the felt 16A, is sandwiched between the felt 16A and the drums 11A, 12A and 13A. However, the web WA in extending around the lower drums 14A and 15A is disposed on the outer surface of the felt 16A and, therefore, has a tendency to detach from the lower drums 14A and 15A by centrifugal force. Additionally, at high speeds, there is a tendency for a buildup of air pressure within the pockets 30 and 32 at the ingoing nips 34 and 36 which tends to blow the web from the supporting felt as shown in FIG. 2.

Additionally, as shown in FIG. 2, the felt 16A is sandwiched between the web WA and the drums 14A and 15A thereby reducing the drying effect of the drums 14A and 15A.

FIG. 3 is a perspective view of a so-called BEL RUN dryer configuration generally designated 10B according to the present invention for maintaining a first and second lateral edge 38 and 40 respectively of a web WB in close conformity with a dryer felt 16B of a papermaking machine.

The apparatus 10B includes a first dryer drum 11B of the papermaking machine with the first drum 11B being rotatable about an axis 42 which is parallel to the cross-machine direction CM of the web WB. A second dryer drum 12B is rotatable about an axis 44 which is spaced and parallel to the axis 42 of the first dryer drum 11B. An intermediate transfer roll 46 has an axis of rotation 48 which is disposed in a plane P parallel to, and between, the axes 42 and 44 of the first and second drums 11B and 12B such that the web WB and the felt 16B extend contiguously around the first dryer drum 11B and then around the transfer roll 46 and subsequently around the second drum 12B in a serpentine configuration so that the transfer roll 46 and the felt 16B define therebetween a pocket 30B. A first box 50 is disposed within the pocket 30B and adjacent to the first lateral edge 38 of the web WB for maintaining a partial vacuum within the pocket 30B adjacent to the first lateral edge 38. The arrangement is such that the first lateral edge 38 is drawn into close conformity with the felt 16B, the felt 16B being disposed between the web WB and the first box 50 thereby inhibiting detachment of the first lateral edge 38 from the felt 16B and subsequent wrinkling of the dried web WB.

FIG. 4 is a sectional view on the line 4—4 of FIG. 3 and shows a second box 52 which is disposed within the pocket 30B and adjacent to the second lateral edge 40 of the web WB for maintaining a partial vacuum within the pocket 30B adjacent to the second lateral edge 40. The arrangement is such that the second lateral edge 40 is drawn into close conformity with the felt 16B, the felt 16B being disposed between the web WB and the second box 52 thereby inhibiting detachment of the second lateral edge 40 from the felt 16B and subsequent wrinkling of the dried web WB.

FIG. 5 is a plan view of a first embodiment of the apparatus shown in FIGS. 3 and 4 showing the disposition of the first and second boxes 50 and 52 respectively. FIG. 5 also shows a first and second lateral seal means generally designated 53 and 55 respectively for sealing the first box 50 within the pocket 30B such that the lateral flow of air within the pocket and past the first box 50 is inhibited.

FIG. 6 is an enlarged, fragmentary view of the first box 50 which includes a first divergent wall 54 which extends between the first drum 11B and the transfer roll 46 such that in use of the apparatus movement of the web WB and contiguous felt 16B relative to the first divergent wall 54 generates a partial vacuum between the first divergent wall 54 and the felt 16B extending from the first drum 11B to the transfer roll 46 so that the first lateral edge 38 of the web WB is drawn into close conformity with the felt 16B.

The first box 50, as shown in FIG. 6, further includes a second divergent wall 56 which extends between the transfer roll 46 and the second drum 12B such that during movement of the felt 16B from the transfer roll 46 to the second drum 12B, a partial vacuum is generated between the second divergent wall 56 and the felt 16B between the transfer roll 46 and the second drum 12B for drawing the first lateral edge 38 of the web WB into close conformity with the felt 16B.

As shown in FIG. 6, the first box 50 also includes a transverse seal 58 which extends from the first divergent wall 54 to the felt 16B such that the transverse seal 58 slidingly engages the felt 16B as the felt 16B diverges relative to the first drum 11B so that boundary air, as indicated by the arrow BA, which is entrained by the felt 16B extending around the first dryer drum 11B is diverted from entry into the pocket 30B adjacent to the first lateral edge 38 of the web WB.

Figure 7:
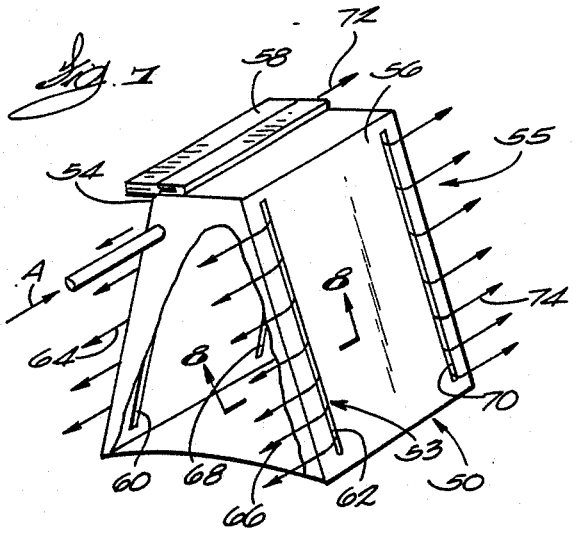
FIG. 7 is a perspective view of the first box shown in FIG. 3.
Figure 8:
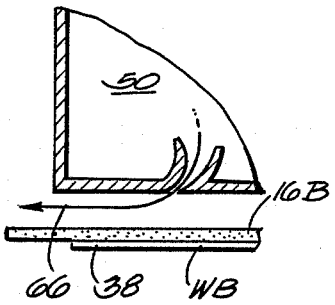
FIG. 8 is a sectional view taken on the line 8—8 of FIG. 7 showing how pressurized air within the first box flows through longitudinal orifices to create a partial vacuum by means of the Coanda principle.

FIG. 7 is a perspective view partially broken away of a first embodiment of the present invention wherein the first lateral seal means 53 includes a first and second longitudinal orifice 60 and 62 defined respectively by the first and second divergent walls 54 and 56 such that when the first box 50 is connected to a source of pressurized air as indicated by the arrow A, a first and second curtain of air 64 and 66 flows respectively through the first and second orifices 60 and 62 and laterally away from the pocket 30B for sealing the first and second divergent walls 54 and 56 relative to the felt 16B. The second lateral seal means 55 includes third and fourth longitudinal orifices 68 and 70 respectively defined by walls 54 and 56 such that when the first box 50 is connected to the source of pressurized air A, a third and fourth curtain of air 72 and 74 respectively, flows through the third and fourth orifices 68 and 70 and in a direction opposite to the direction of flow of the first and second curtains of air 64 and 66 respectively such that the first and second divergent walls 54 and 56 are sealed relative to the felt 16B.

Figure 9:
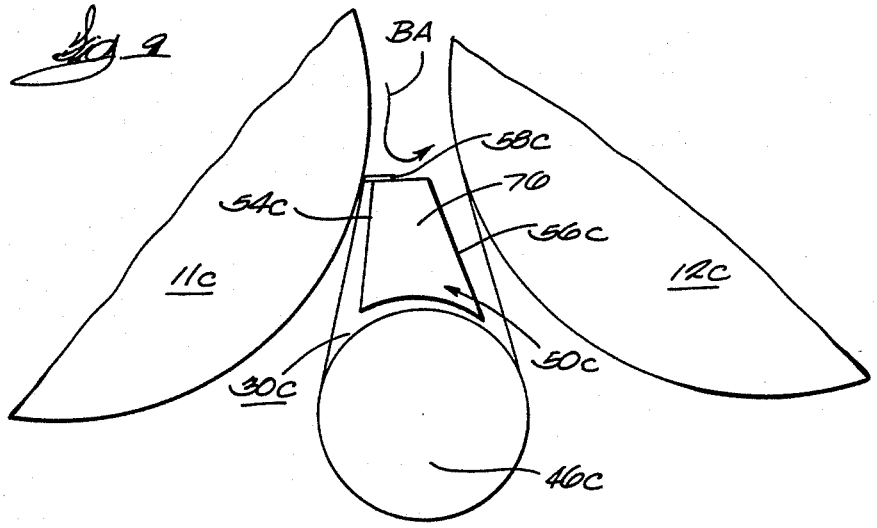
FIG. 9 is a side-elevational view of a second embodiment of the present invention in which vacuum within the transfer roll is used to create an underpressure adjacent to the boxes.

FIG. 9 shows a second embodiment of the present invention in which the first box 50C also includes a first side wall 76 which extends from the first divergent wall 54C toward the second divergent wall 56C.

Figure 10:
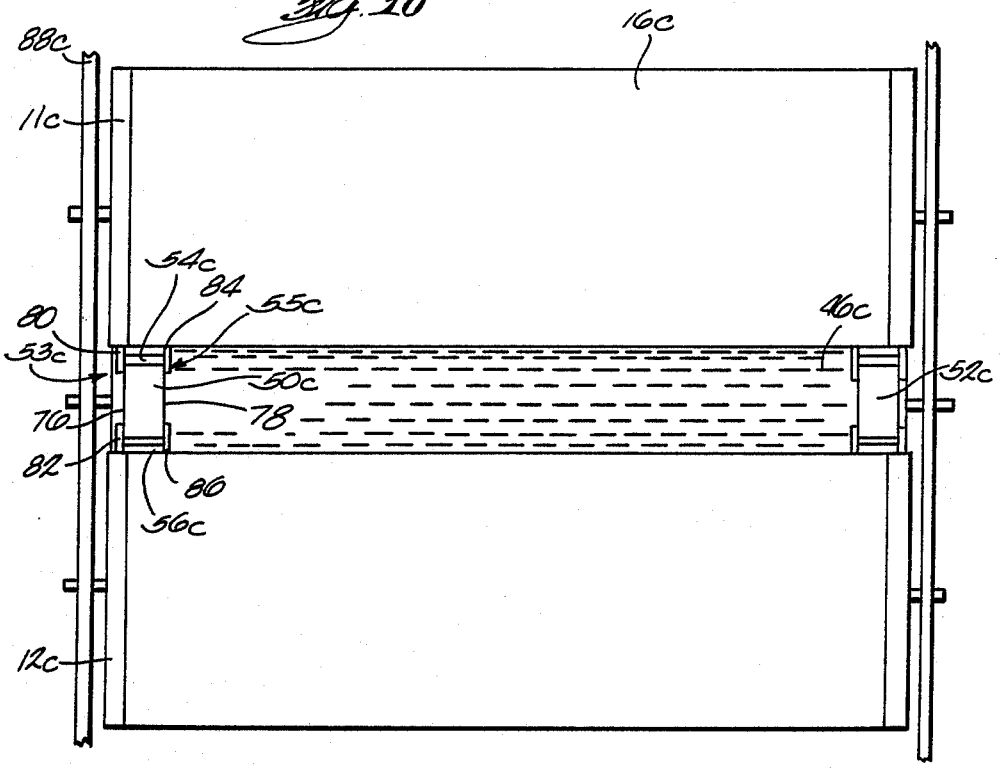
FIG. 10 is a plan view of the embodiment shown in FIG. 9.

FIG. 10 is a plan view of the second embodiment shown in FIG. 9. FIG. 10 shows a second side wall 78 which is spaced relative to the first side wall 76 with the second side wall 78 extending from the first divergent wall 54C to the second divergent wall 56C. The first lateral seal means 53C also includes a first seal 80 which extends from the first side wall 76 to the felt 16C for sealingly engaging the felt 16C moving between the first drum 11C and the transfer roll 46C. A second seal 82 extends from the first side wall 76 to the felt 16C for sealingly engaging the felt 16C moving from the transfer roll 46C to the second dryer 12C. A third seal 84 extends from the second side wall 78 to the felt 16C for sealingly engaging the felt 16C moving from the first drum 11C to the transfer roll 46C. A fourth seal 86 extends from the second side wall 78 to the felt 16C for sealingly engaging the felt 16C moving from the transfer roll 46C to the second drum 12C. The first, second, third and fourth seals 80,82,84 and 86 respectively, inhibit lateral flow of air towards, and away, from the pocket 30C past the first box 50C.

In each of the aforementioned embodiments, the intermediate transfer roll is connected to a source of partial vacuum such that the web is drawn into close conformity with the felt during passage of the web around the transfer roll, the felt being disposed between the web and the transfer roll. However, in the second embodiment of the present invention, the partial vacuum within the transfer roll is in fluid communication, as shown in FIGS. 9 and 10 with the first pocket 30C such that the partial vacuum generated by the divergent walls is enhanced by the vacuum from the transfer roll.

In each of the aforementioned embodiments, the dryer drums and the transfer roll are rotatably supported by a frame 88 as shown in FIGS. 4 and 5 and by frame 88C as shown in FIG. 10. The boxes are secured to such frame thereby avoiding thermal and mechanical distortion associated with prior art blow boxes extending across the entire width of the felt.

Figure 11:
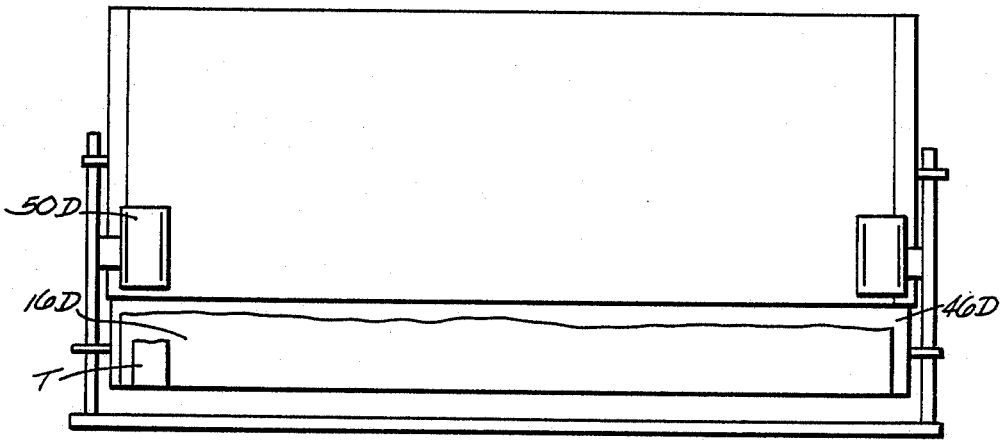
FIG. 11 is a view which is similar to that shown in FIG. 4 but showing the apparatus assisting in the threading of a tail of the web.

As shown in FIG. 11, the box 50D assists in the threading of a tail T of the web through the dryer section because the suction applied to the felt 16D across the entire width thereof by means of the suction transfer roll 46D is augmented by the box 50D of the present invention. Such increase in suction in the vicinity of the box 50D assists in positively drawing the tail T into close conformity with the web thereby simplifying the threading operation.

In operation of the dryer section according to the present invention, in the first embodiment of the present invention as shown in FIGS. 3–8. during use of the apparatus a partial vacuum is generated between the divergent walls 54 and 56 and the felt 16B by reason of the movement of the felt 16B past the divergent walls. Such partial vacuum draws the lateral edges 38 and 40 of the web WB into close conformity with the supporting felt 16B.

Additionally, according to the first embodiment of the present invention, the boxes 50 and 52 are connected to a source of pressurized air such that the air flows from the boxes 50 and 52 and due to the Coanda principle, the air curtains 64, 66, 72 and 74 not only seal the box 50 against lateral flow of air into or away from the pocket 30B past the boxes but also generates a partial vacuum between the respective boxes and the adjacent moving felt thereby assisting in drawing the lateral edges 38 and 40 of the web WB into conformity with the felt 16B.

In operation of the second embodiment of the present invention as shown in FIGS. 9 and 10, the boxes 50C and 52C are disposed in close proximity to the transfer roll 46C such that the partial vacuum generated within the transfer roll 46C is in fluid communication with the pocket 30C adjacent to the respective boxes so that the partial vacuum generated by means of the divergent walls 54C and 56C is supplemented and enhanced by the partial vacuum existing within the transfer roll 46C.

In operation of the apparatus as shown in FIG. 11, the tail T is threaded around the transfer roll 46D and is held in close conformity with the felt by the vacuum generated by the box 50D.

The present invention provides a simple and inexpensive means for overcoming the problem of edge wrinkling during drying of a paper web. Furthermore, the present invention not only avoids the costly provision of blow boxes extending across the entire width of the felt, but also avoids the attendant problems of thermal and mechanical distortion associated with such boxes.

What is claimed is:

1. An apparatus for maintaining a first and second lateral edge of a web in close conformity with a dryer felt of a papermaking machine, said apparatus comprising:

a first dryer drum of the papermaking machine, said first drum being rotatable about an axis which is parallel to the cross-machine direction of the web;

a second dryer drum, rotatable about an axis spaced and parallel to said axis of said first dryer drum;

an intermediate vacuum transfer roll, said transfer roll having an axis of rotation which is disposed in a plane parallel to, and between, the axes of said first and second drums such that the web and the felt extend contiguously around said first dryer drum and then around said transfer roll and subsequently around said second drum in a serpentine configuration so that said transfer roll and the felt define therebetween a pocket;

a first box disposed within said pocket and adjacent to the first lateral edge of the web, for maintaining a partial vacuum within said pocket adjacent to the first lateral edge such that the first lateral edge is drawn into close conformity with the felt which is disposed between the web and said first box thereby inhibiting detachment of the first lateral edge from the felt and subsequent wrinkling of the dried web; and a second box disposed within said pocket and adjacent to the second lateral edge of the web for maintaining a partial vacuum within said pocket adjacent to the second lateral edge such that the second lateral edge is drawn into close conformity with the felt which is disposed between the web and said second box thereby inhibiting detachment of the second lateral edge from the felt and subsequent wrinkling of the dried web.

2. An apparatus as set forth in claim 1 wherein said first box includes:

a first divergent wall extending between said first drum and said transfer roll such that in use of said apparatus, movement of the web and contiguous felt relative to said first divergent wall generates a partial vacuum between said first box and the felt extending from said first drum to said transfer roll so that the first lateral edge of the web is drawn into close conformity with the felt.

3. An apparatus as set forth in claim 1 wherein said first box further includes:

a second divergent wall which extends between said transfer roll and said second drum such that during movement of the felt from said transfer roll to said second drum, a partial vacuum is generated between said second divergent wall and said felt between said transfer roll and said second drum for drawing the first lateral edge of the web into close conformity with the felt.

4. An apparatus as set forth in claim 1 wherein said first box further includes:

a first and second divergent wall, said first and second walls extending between said transfer roll and respectively said first and second drums such that during movement of the felt between said first and second drums, a partial vacuum is generated between said first divergent wall and the felt extending from said first drum to said transfer roll while a partial vacuum is also generated between said second divergent wall and the felt extending from said transfer roll to said second drum so that the first lateral edge of the web is maintained in close conformity with the felt during transit between said first and second drums.

5. An apparatus as set forth in claim 4 wherein said first box further includes:

a transverse seal extending from said first divergent wall to said felt such that said seal slidingly engages the felt as the felt diverges relative to said first drum so that boundary air entrained by the felt extending around said first drum is diverted from entry into said pocket adjacent to said first lateral edge of the web.

6. An apparatus as set forth in claim 4 wherein said first box further includes:

a first and a second lateral seal means for sealing said first box within said pocket such that lateral flow of air within said pocket and past said first box is inhibited.

7. An apparatus as set forth in claim 6 wherein said first lateral seal means includes;

a first and second longitudinal orifice defined respectively by said first and second divergent walls such that when said first box is connected to a source of pressurized air, a first and second curtain of air flows respectively through said first and second orifices and laterally away from said pocket for sealing said first and second divergent walls respectively relative to the felt;

said second lateral seal means including; third and fourth longitudinal orifices defined by said first and second divergent walls respectively such that when said first box is connected to said source of pressurized air, a third and fourth curtain of air flows through said third and fourth orifices respectively and in a direction opposite to the direction of flow of said first and second curtains of air, respectively, such that said first and second divergent walls are sealed relative to the felt.

8. An apparatus as set forth in claim 6 wherein said first box further includes;

a first side wall extending from said first divergent wall towards said second divergent wall;

a second side wall spaced relative to said first side wall, said second side wall extending from said first divergent wall to said second divergent wall;

said first lateral seal means further including: a first seal extending from said first side wall to the felt for sealingly engaging the felt moving between said first drum and said transfer roll;

a second seal extending from said first side wall to the felt for sealingly engaging the felt moving from said transfer roll to said second dryer;

said second lateral seal means further including:

a third seal extending from said second side wall to the felt for sealingly engaging the felt moving from said first drum to said transfer roll;

a fourth seal extending from said second side wall to the felt for sealingly engaging the felt moving from said transfer roll to said second drum;

said first, second, third and fourth seals inhibiting lateral flow of air towards, and away from, said pocket past said first box.

9. An apparatus as set forth in claim 4 wherein:

said intermediate transfer roll is connected to a source of partial vacuum such that the web is drawn into close conformity with the felt during passage of the web around said transfer roll, the felt being disposed between the web and said transfer roll; and said partial vacuum within said transfer roll being in fluid communication with said pocket such that a partial vacuum is maintained within said pocket adjacent to said first box for augmenting the partial vacuum generated by movement of the felt past said divergent walls.

10. An apparatus as set forth in claim 1 further including;

a frame for rotatably supporting said first and second drums and said transfer roll;

said first and second boxes being secured to said frame.

11. An apparatus as set forth in claim 7 wherein said curtains of air flow away from said first box thereby inducing a partial vacuum in the vicinity of the first lateral edge by the Coanda principle.

12. An apparatus as set forth in claim 1 wherein at least one of said boxes increases said partial vacuum adjacent to a respective box thereby stabilizing a threading tail of the web during threading of the apparatus.

13. An apparatus for maintaining a first and second lateral edge of a web in close conformity with a dryer felt of a papermaking machine, said apparatus comprising:

a first dryer drum of the papermaking machine, said first drum being rotatable about an axis which is parallel to the cross-machine direction of the web;

a second dryer drum rotatable about an axis spaced and parallel to said axis of said first dryer drum;

an intermediate vacuum transfer roll, said transfer roll having an axis of rotation which is disposed in a plane parallel to, and between, the axes of said first and second drums such that the web and the felt extend contiguously around said first dryer drum and then around said transfer roll and subsequently around said second drum in a serpentine configuration so that said transfer roll and the felt define therebetween a pocket;

a first box disposed within said pocket and adjacent to the first lateral edge of the web for maintaining a partial vacuum within said pocket adjacent to the first lateral edge such that the first lateral edge is drawn into close conformity with the felt which is disposed between the web and said first box thereby inhibiting detachment of the first lateral edge from the felt and subsequent wrinkling of the dried web;

a second box disposed within said pocket and adjacent to the second lateral edge of the web for maintaining a partial vacuum within said pocket adjacent to the second lateral edge such that the second lateral edge is drawn into close conformity with the felt which is disposed between the web and said second box thereby inhibiting detachment of the second lateral edge from the felt and subsequent wrinkling of the dried web; and said boxes being disposed within said pocket such that said partial vacuum is maintained between the lateral edges and said respective boxes.

14. A method of maintaining a first and second lateral edge of a web in close conformity with a dryer felt of a papermaking machine, said method comprising the steps of:

inducing a partial vacuum between the felt and a respective first and second box disposed adjacent to the lateral edges of the web; and moving a joint run of the web and felt relative to divergent walls of the boxes for generating a further vacuum such that the further vacuum augments the partial vacuum for drawing the edges of the web into close conformity with the felt thereby inhibiting fluttering of the web relative to the felt.

* * * * *